US005672009A

United States Patent [19]

Malin

[11] Patent Number: 5,672,009

[45] Date of Patent: Sep. 30, 1997

[54] RECLOSABLE POUCH AND ZIPPER THEREFOR

[75] Inventor: Art Malin, Northbrook, Ill.

[73] Assignee: Illinois Tool Works Inc., Glenview, Ill.

[21] Appl. No.: 651,977

[22] Filed: May 21, 1996

[51] Int. Cl.[6] ..... B65D 33/25

[52] U.S. Cl. ..... 383/204; 24/587; 383/61; 383/63; 383/211

[58] Field of Search ..... 383/210, 211, 383/63, 65, 61, 204, 209; 24/587

[56] References Cited

U.S. PATENT DOCUMENTS

| | | | |
|---|---|---|---|
| 3,780,781 | 12/1973 | Uramoto | 383/65 |
| 3,827,472 | 8/1974 | Uramoto | 383/63 |
| 4,817,188 | 3/1989 | Van Erden | 383/63 |
| 4,923,309 | 5/1990 | Van Erden | 383/210 |
| 5,017,021 | 5/1991 | Simonsen et al. | 383/63 |
| 5,092,684 | 3/1992 | Weeks | 383/61 |
| 5,186,543 | 2/1993 | Cochran | 383/63 |
| 5,509,735 | 4/1996 | May | 383/210 |
| 5,525,363 | 6/1996 | Herver et al. | 383/61 |

*Primary Examiner*—Stephen P. Garbe

*Attorney, Agent, or Firm*—Kane, Dalsimer, Sullivan, Kurucz, Levy, Eisele and Richard, LLP

[57] ABSTRACT

A reclosable plastic pouch has a first elongated zipper member having a profile and a flange having a longitudinal perforation therein. The flange is above the profile and attached to one wall of the pouch above and below the perforation line and to the opposite wall of the pouch only above the perforation line. A mating profile is attached only to the opposite wall of the pouch below the perforation line. A notch at an edge of the pouch, aligned with the perforation line, facilitates the plastic to tear along the perforation line so that the portion of the pouch above the perforation line may be readily removed.

24 Claims, 2 Drawing Sheets

RECLOSABLE POUCH AND ZIPPER THEREFOR

BACKGROUND OF THE INVENTION

The present invention relates to reclosable packaging and in particular to reclosable packaging that may readily be formed, filled and sealed and yet is relatively easy for a consumer to open and reclose.

Plastic, resealable pouches are gaining in popularity both for storage and as primary packaging. Such pouches rely on zipper profiles which mate to form a closure that may easily separated by a consumer. For primary packaging, it is often important that the packaging be formed on FFS (form, fill and seal) equipment at the facility of the food processor. It is also important that the packaging be capable of being sealed (not merely closed with the zipper closure engaged) to preserve the freshness of the food contained therein and be tamper proof or, at least, provide evidence of tampering. That is, the package seal must first be opened to provide access to the zipper whereafter the zipper may be opened to provide access to the bag contents. Thereafter any remaining portion of the product can be restored in the original package relying on zipper to close the package.

Removal of the seal requires either that the consumer use a scissor or knife to open the pouch above the closure or that the package be provided with a tear string or tear strip for that purpose. While it is relatively easy to provide such tear strings or strips in pouches in which the zipper runs parallel to the running direction of the film from which the pouch is formed, it is somewhat more complicated to do so where the zipper runs transverse to the running direction of the film as in U.S. Pat. No. 4,655,862 or U.S. Pat. No. 5,461,845.

SUMMARY OF THE INVENTION

It is the principle object of the present invention to provide an improved zipper for reclosable packaging and an improved reclosable package incorporating such zipper.

A further object is to provide such a package with tamper evident means for sealing and protecting the contents of goods contained therein.

A still further object is to provide such a package which can readily be opened by a consumer without relying on a cutting implement, tear string or the like.

A still further object is to provide a reclosable package wherein the zipper profiles may readily be utilized with appropriate FFS equipment so that the zipper may be attached parallel to or transverse to the running direction of the film from which the package is formed.

The above and other objects and advantages are attained in accordance with the present invention by providing a reclosable package having first and second pouch walls having free edges defining the package top. A zipper is secured to the package between the pouch walls at the package top. The zipper comprises a first zipper member and a second zipper member, the zipper members having mating zipper profiles thereon. The first zipper member comprises a longitudinally extending profile portion and a flange portion disposed above and coextensive with the profile portion. A perforation line extends longitudinally along and coextensive with the flange portion. The second zipper member comprises a string (i.e. flangeless) profile, complementary to the profile of the first zipper member.

The flange portion of the first zipper member is secured to one of the pouch walls in a longitudinally extending area disposed above and below the perforation line. The flange is also connected to the opposite pouch wall but only in an area above the perforation line. The second zipper member is also connected to the opposite pouch wall but only in an area below the perforation line. A tear notch is provided in a side of the package aligned with the perforation line. If desired a peel sealable material may be provided extending longitudinally and disposed below the perforation line between the flange and opposite pouch wall.

DETAILED DESCRIPTION OF THE PREFERRED EMBODIMENTS

Figure 1:
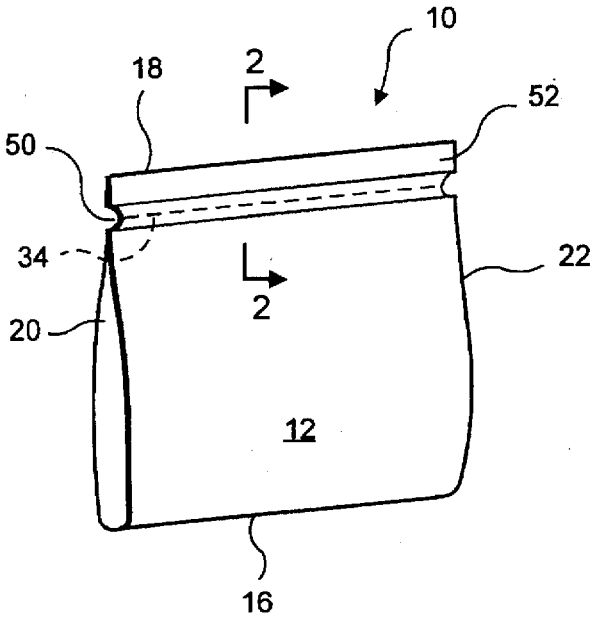
FIG. 1 is a perspective view of a package in accordance with the present invention.

Reference is now made to the drawings and to FIG. 1 in particular wherein a package or pouch 10 formed of plastic film or sheet and utilizing a zipper in accordance with the present invention is depicted. The pouch 10 comprises front and back walls 12, 14, a bottom 16, top 18 and sides 20, 22. Depending on the shape of the plastic sheet and the positioning of the seams, one or both of the sides 20, 22 may be made by sealing the front and back walls or by folds if the pouch walls are formed from the same sheet of plastic film. The bottom 16 may likewise be formed by sealing the front and back walls together or by a fold in a common sheet of material, again depending upon the orientation of the profiles with respect to the film and the seams used to form the packaging. The profiles may extend parallel to or transverse to the running direction of the film as it is formed into a pouch depending on the nature of the FFS equipment used to form the pouch.

Figure 3:
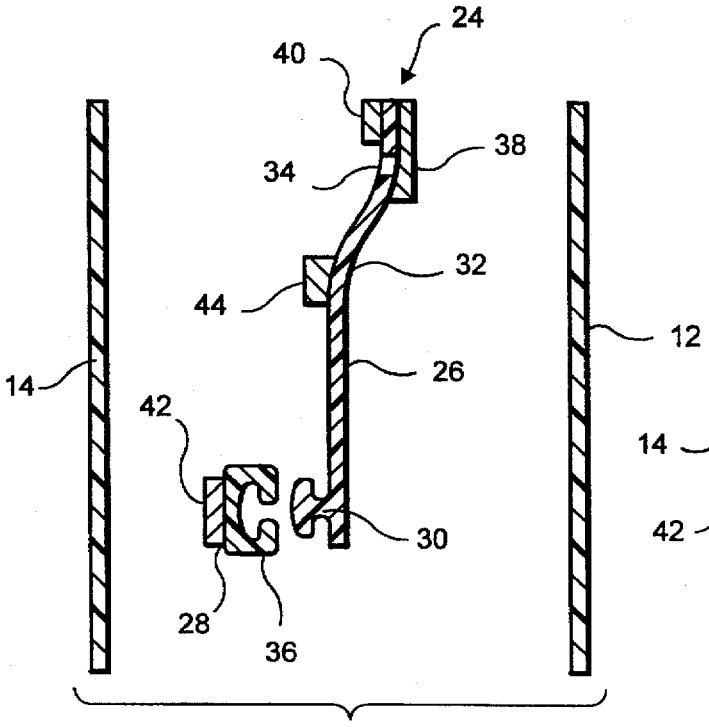
FIG. 3 is an exploded view of the components of the package of FIG. 1.

As shown in FIG. 3, a zipper 24 is provided at the bag top between the bag walls. Zipper 24 comprises a front zipper member 26 and a second zipper member 28. Zipper member 26 includes a longitudinally extending profile portion 30 and a longitudinally extending flange portion 32. The flange portion 32 is positioned above the profile portion 30 and runs to the top 18 of pouch 10. A perforation line 34 extends longitudinally along the flange 32. As shown, the profile portion 30 is in the form of an asymmetric arrow head designed to mate with a corresponding female profile 36 of zipper member 28. Zipper member 28 is a so-called "string" zipper in that it has no flange portion above or below the profile. That is, the base of the profile attach directly to the pouch film. It should be appreciated that the shape of profiles 30 and 36 is immaterial to the present invention so long as they are complementary to each other so that they can mate with each other.

A first adhesive or sealant 38 is provided to zipper member 26 in a longitudinally extending area disposed both above and below the perforation line 34. Sealant 38 serves to join the flange 32 to pouch wall 12 in an area extending on both sides of the perforation line 34. A second longitudinally extending adhesive or sealant 40 is provided on the opposite side of flange 32 but in an area that is disposed only above the perforation line 34. The second sealant 40 serves to join the flange 32 to pouch wall 14. A third longitudinally extending sealant 42 is provided to the base of zipper member 28 opposite the profile and serves to join the zipper string to pouch wall 14. It should be appreciated that the sealants 38, 40, and 42 may all be formed of the same material, such as a heat activated adhesive or fusible material. It should also be appreciated that the sealants 38, 40 and 42 may be formed integral with and comprise the same material as profiles 26 and 28 although doing so would make it somewhat more difficult to attach the zipper only in the desired attachment zones, requiring very precise heating elements for attaching the zipper to the pouch walls. Accordingly, the use of sealants separate from the zipper members is preferred. This is also true of the sealants of the alternate embodiment described below.

To further protect the contents of package 10 a longitudinally extending line of peel seal material 44 may be provided on the same side of flange 26 as sealant 40 but below the perforation line 34. The material 44 forms a peel seal between the flange 26 and pouch wall 14. Such peel seals are well known and widely used to form readily openable seals in plastic packaging.

Figure 2:
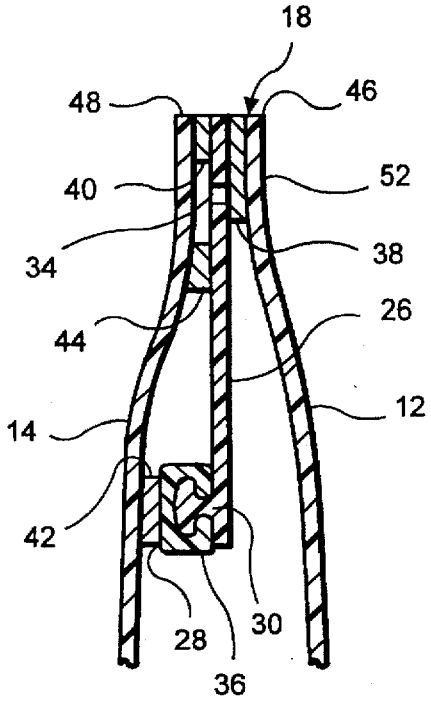
FIG. 2 is a fragmentary side elevational view taken along section lines 2—2 of FIG. 1.
Figure 4:
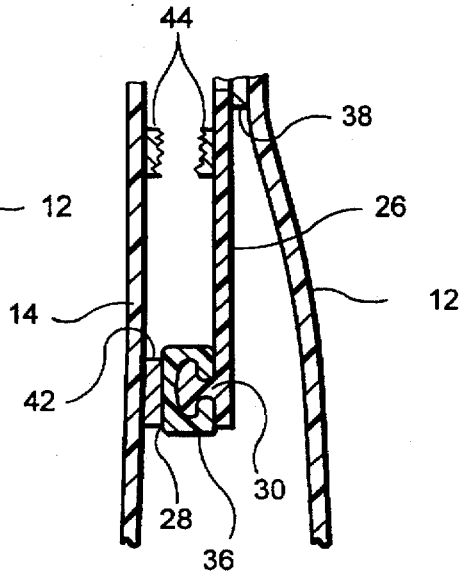
FIG. 4 is a view similar to FIG. 2 depicting the package after the header seal has been removed and peel seal ruptured; and, FIG. 5 is a view similar to FIG. 4 depicting an alternate construction of a package in accordance with the present invention.

As shown in FIG. 2, free edges 46 and 48 of pouch walls 12 and 14 are brought together and joined in a seal with the top of flange 26. The seal is formed when sealants 38 and 40 are activated. At this point the package is as shown in FIG. 2 with the contents of the package sealed below the seal and also below the peel seal, if a peel seal is also used. A notch 50 is provided in one or both sides of the pouch. The notch is aligned with the perforation line 34 and enables a customer wishing to open the package for the first time, to start a run of the plastic material. The run will naturally proceed along the perforation line 34. As a result, the header 52 (i.e. the portion of the package above perforation line 34) will be detached from the pouch and may be removed. The customer may then continue to open the package by pulling the pouch walls 12 and 14 apart which will result in the peel seal 44 rupturing as shown in FIG. 4. Thereafter, if the consumer continues to pull the bag walls apart the consumer can gain access to the package by separating the profiles 30 and 36. Thereafter the consumer can reclose the package by re-engaging the profiles.

Figure 5:
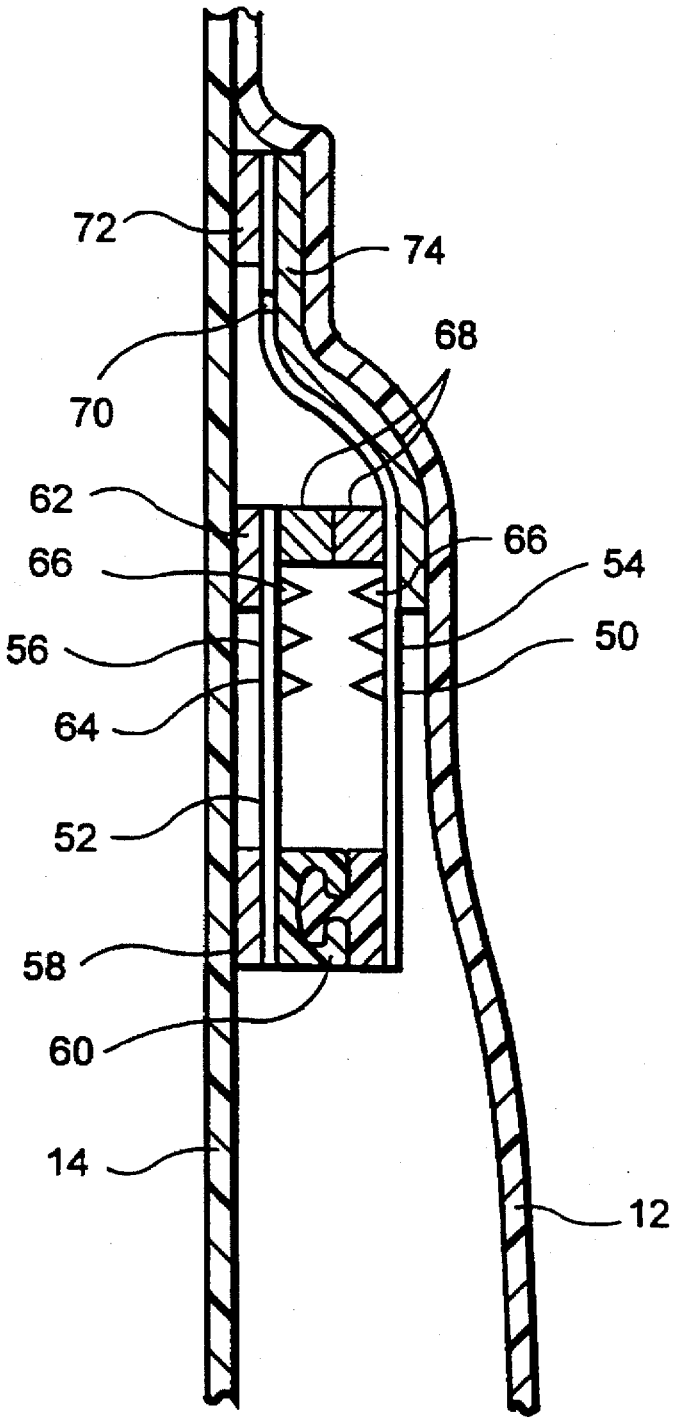

In FIG. 5 an alternate construction of a package in accordance with the present invention is depicted. In accordance with this embodiment, both zipper members 50 and 52 have flanges, although the flange 54 of member 50 is substantially larger than the flange 56 of zipper member 52. A sealant or adhesive strip 58 is provided directly behind the profile 60 of member 52 and another sealant or adhesive strip 62 is provided at the top of the flange 64 of member 52. A series of gripper ribs 66 are provided on flange 64. Zipper member 50 is substantially the same as zipper member 26 of the first embodiment except that gripper ribs 66 are also provided on the flange 54.

Peel seal strips 68 are provided on the inside surfaces of flanges 54 and 56, aligned with each other and positioned above the gripper ribs 66, but below the perforation line 70 of flange 54. Flange 54 is connected to the inner surface of pouch wall 14 by sealant or adhesive strip 72 which is positioned only above the perforation line 70. A sealant or adhesive strip 74 connects the flange 54 to the inner surface of pouch wall 12, from the top of the flange, above the perforation line, to a point below the peel seal 68. The construction and operation of the pouch of this embodiment are otherwise as described above, in connection with the first embodiment.

It should be appreciated that the disclosed zipper is particularly well suited for the transverse application to the packaging film since there is no tear string or the like which must be severed during application of the zipper to the film. Thus, in accordance with the above, the aforementioned objects are attained.

Having thus described the invention, what is claimed is:

1. A zipper for use in reclosable packaging comprising:

a first longitudinally extending zipper member having:

a first elongated zipper profile directed to one side of said first zipper member and disposed on a lower portion of said first zipper member; an elongated flange coextensive with said first zipper profile disposed on an upper portion of said first zipper member; a perforation line extending longitudinally along said flange; first securing means on a side of said first zipper member opposite to said one side and disposed both above and below said perforation line and second securing means on said first zipper member one side disposed only above said perforation line; and, a second longitudinally extending zipper member having:

a second elongated zipper profile, complementary to said first zipper profile and directed toward said first profile, and, third securing means on a side of said second zipper member opposite to said second profile.

2. The zipper in accordance with claim 1, wherein said first and second profiles are interlocked.

3. The zipper in accordance with claim 1, wherein said first second and third securing means comprise a heat activated sealant.

4. The zipper in accordance with claim 1, wherein said third securing means is disposed directly behind said second profile.

5. The zipper in accordance with claim 4, wherein said second longitudinally extending zipper member is substantially flangeless.

6. The zipper in accordance with claim 1, further comprising a peel seal sealant on said one side of said first zipper member disposed below said perforation line.

7. A resealable pouch comprising:

a first pouch wall;

a second pouch wall;

a first longitudinally extending zipper member having an elongated first profile portion at a lower part thereof and a flange portion disposed above said first profile portion, a perforation line in said flange portion, first means securing one side of said flange to said first pouch wall in an area above and below said perforation line, second means securing an opposite side of said flange to said second pouch wall in a longitudinally extending area only above said perforation line;

a second longitudinally extending zipper member having a second profile portion complementary to said first profile portion; and, third means securing said second zipper member to said second pouch wall.

8. A reclosable pouch in accordance with claim 7, further comprising a longitudinally extending peel seal extending between said second pouch wall and said flange and disposed below said perforation line.

9. A reclosable pouch in accordance with claim 8, wherein said first profile portion and said secured profile portion are mated with each other.

10. A reclosable pouch in accordance with claim 9, wherein said third securing means is directly behind said second profile portion.

11. A reclosable pouch in accordance with claim 7, wherein said first pouch wall and said second pouch walls have free edges and said first and second securing means join said flange and said pouch walls' free edges in a seal.

12. A reclosable pouch in accordance with claim 7, further comprising a tear notch at a side edge of said pouch extending through said flange and first and second pouch walls and aligned with said perforations.

13. A reclosable pouch in accordance with claim 7, wherein said first, second and third securing means comprise a heat activated adhesive.

14. The zipper in accordance with claim 4, wherein said second zipper member includes an elongated flange coextensive with said second zipper profile and extending upwardly from said second zipper profile to a point below said perforation line of said first zipper member flange.

15. The zipper in accordance with claim 14, further comprising additional securing means on said side of said second zipper member opposite to said second zipper profile and positioned on said second zipper member flange.

16. The zipper in accordance with claim 14, further comprising at least one gripper rib on at least one of said first and second zipper member flanges below said perforation line.

17. The zipper in accordance with claim 16, wherein both of said first and second zipper member flanges contain at least one gripper rib.

18. The zipper in accordance with claim 14, further comprising a peel seal sealant on at least one of said first and second zipper members, below an upper edge of said second zipper member flange.

19. The zipper in accordance with claim 18, further comprising at least one gripper rib on at least one of said first and second zipper member flanges and below said peel seal sealant.

20. The zipper in accordance with claim 19, wherein both of said first and second zipper member flanges contain at least one gripper rib thereon below said peel seal sealant.

21. A resealable pouch in accordance with claim 7, further comprising a flange on said second zipper member above said second profile portion, said second zipper member flange having a top edge disposed below said perforation line.

22. A resealable pouch in accordance with claim 21, further at least one gripper rib on at least one of said first and second zipper member flanges below said perforation line.

23. A resealable pouch in accordance with claim 21, further comprising a longitudinally extending peel seal between said first and second zipper member flanges.

24. A resealable pouch in accordance with claim 21, further at least one gripper rib on at least one of said first and second zipper member flanges below said peel seal.

* * * * *